US008034198B2

(12) United States Patent
Minami et al.

(10) Patent No.: US 8,034,198 B2
(45) Date of Patent: Oct. 11, 2011

(54) AUSTENITIC STAINLESS STEEL TUBE FOR BOILER WITH EXCELLENT RESISTANCE TO HIGH TEMPERATURE STEAM OXIDATION

(75) Inventors: Yusuke Minami, Kawasaki (JP); Hitoshi Iijima, Kawasaki (JP); Motohisa Yoshida, Kawasaki (JP); Toshihiko Fukui, Kawasaki (JP); Tatsuo Ono, Kawasaki (JP)

(73) Assignee: NKK Tubes, Kanagawa (JP)

( * ) Notice: Subject to any disclaimer, the term of this patent is extended or adjusted under 35 U.S.C. 154(b) by 363 days.

(21) Appl. No.: 12/438,526

(22) PCT Filed: Aug. 23, 2006

(86) PCT No.: PCT/JP2006/316453

§ 371 (c)(1),
(2), (4) Date: Feb. 23, 2009

(87) PCT Pub. No.: WO2008/023410

PCT Pub. Date: Feb. 28, 2008

(65) Prior Publication Data

US 2009/0246064 A1 Oct. 1, 2009

(51) Int. Cl.
*C21D 8/10* (2006.01)
*C21D 9/08* (2006.01)

(52) U.S. Cl. ..... 148/325; 148/592; 148/593; 148/909; 29/90.7; 72/53

(58) Field of Classification Search ..... 148/591–594, 148/909, 325, 327; 29/90.7; 72/53
See application file for complete search history.

(56) References Cited

U.S. PATENT DOCUMENTS 4,086,104 A 4/1978 Kinoshita et al.

FOREIGN PATENT DOCUMENTS

| | | | |
|---|---|---|---|
| JP | 49135822 | A | 12/1974 |
| JP | 52008930 | A | 1/1977 |
| JP | 53114722 | A | 10/1978 |
| JP | 54138814 | A | 10/1979 |
| JP | 5558329 | A | 5/1980 |
| JP | 58039733 | A | 3/1983 |
| JP | 2228468 | A | 9/1990 |
| JP | 6322489 | A | 11/1994 |

OTHER PUBLICATIONS

Machine-English translation of Japanese patent 06-322489, Otsuka Nobuo et al., Nov. 22, 1994.*

Kanero et al.; "Mechanical Properties of Shot-Blasted Stainless Steel Boiler Tubings"; Thermal and Nuclear Power Engineering, Apr. 1979; pp. 99-105; vol. 30; No. 4. (Partial English-Language Translation Attached).

* cited by examiner

*Primary Examiner* — Deborah Yee
(74) *Attorney, Agent, or Firm* — The Webb Law Firm

(57) ABSTRACT

The present invention relates to an austenitic stainless steel tube for boiler, used for superheater or reheater in thermal power plant, giving excellent resistance to high temperature steam oxidation, in particular to an austenitic stainless steel tube containing 16 to 20% Cr by weight, and being cold-worked at the inner surface of the tube. The Cr concentration in the vicinity of the inner surface of the steel tube is 14% by weight or larger, and the hardness at 100 μm depth from the inner surface of the steel tube is 1.5 times or larger the average hardness of the mother material or is HV 300 or larger.

4 Claims, 2 Drawing Sheets

Steel tube No.A

Steel tube No.G

AUSTENITIC STAINLESS STEEL TUBE FOR BOILER WITH EXCELLENT RESISTANCE TO HIGH TEMPERATURE STEAM OXIDATION

FIELD OF THE INVENTION

The present invention relates to an austenitic stainless steel tube for boiler with excellent resistance to high temperature steam oxidation, being used for superheater or reheater in thermal power plant.

BACKGROUND OF THE INVENTION

An austenitic stainless steel represented by 18Cr-8Ni steel is generally used for superheater or reheater in thermal power plant to ensure high temperature strength. With increase in the steam temperature, however, oxide scale is formed on the inner surface of the steel tube by high temperature steam even in the austenitic stainless steel. Since the austenitic stainless steel generally has large thermal expansion coefficient, the formed oxide scale is exfoliated from the inner surface of the tube by the temperature changes due to the shut-down and start-up cycles of boiler, then the exfoliated scale is deposited at bend sections of the boiler steel tube to induce plugging of the tube. In other cases, the exfoliated scale is scattered into the turbine section to cause erosion of turbine blades.

In recent years, the steam temperature increases more than ever to realize further high efficiency of thermal power plant in view of reduction in $Co_2$ emissions. Accordingly, the improvement in the resistance to high temperature steam oxidation at the inner surface of the steel tube used for these applications, specifically the suppression of oxide scale forming and the prevention of exfoliated oxide scale have become further important technological issues.

As for measures to improve the resistance to steam oxidation for austenitic stainless steels, (1) use of high Cr steel tube, for example 25% Cr steel tube; or (2) use of fine-grained steel tube has been employed. For the case of high Cr steel tube, however, the Ni content is unavoidably increased to form a single austenite phase, resulting in expensive steel tube. For the case of fine-grained steel tube, which improves the resistance to steam oxidation by the refinement of grains in the austenitic stainless steel, the effect is not satisfactory to the increase in the steam temperature. Thus, the fine-grained steel tube cannot prevent the formation of oxide scale, and further encounters to troubles caused by the exfoliation of formed scale.

In JP-A-53-114722, (the term "JP-A" referred to herein signifies the "Unexamined Japanese Patent Publication"), JP-A-54-138814, JP-A-55-58329, and JP-A-58-39733 disclose methods to improve the resistance to steam oxidation by combining cold-working and heat treatment. Those methods are to improve the resistance to steam oxidation by applying heat treatment after cold-working, enhancing the effect of grain refinement accompanied by the recrystallization of the cold-working portion, and enhancing the effect of oxide film formed during the heat treatment. Similar to the above fine-grained steel tube, however, those methods cannot suppress the formation of oxide scale, and they cannot be expected to maintain the resistance to steam oxidation for a long period.

On the other hands a method to improve the resistance to steam oxidation is provided by applying cold-working only to the inner surface of austenitic stainless steel tube. That is, JP-A-49-135822, "A method for preventing high temperature steam oxidation of steel tube for boiler and for heat exchanger, composed of austenitic stainless steel", and JP-A-52-8930, "A method for preventing high temperature steam oxidation of austenitic stainless steel" disclose that the work-hardening on the inner surface of the steel tube by shot-blasting has enhanced good resistance to steam oxidation even under the actual plant condition. The steel tube manufactured by the method disclosed in the prior art has shown sufficient resistance to seam oxidation at a steam temperature of 569° C., as described in the examples.

Regarding the steel tube manufactured by the above method, there is a report comparing the mechanical properties between the shot-blasted inner surface of steel tube and the steel tube without treated by shot-blasting in terms of depth of hardened layer being formed by shot-blasting (Takahiro Kanero and Yusuke Minami, "Mechanical Properties of Shot-blasted Stainless Steel Boiler Tubings", Thermal and Nuclear Power Engineering, Vol. 30, No. 4, pp. 99-105, April, (1979)).

Under the steam conditions in recent years at or higher than 593° C. of steam temperature under ultra supercritical pressures, however, it was confirmed that even the above steel tube with a work-hardening layer on the inner surface of the steel tube by shot-blasting dose not necessarily have the sufficient resistance to high temperature steam oxidation. Consequently, there is a need for an austenitic stainless steel tube with further excellent resistance to high temperature steam oxidation.

DISCLOSURE OF THE INVENTION

An object of the present invention is to provide an austenitic stainless steel tube for boiler with excellent resistance to high temperature steam oxidation to the steam temperature of 593° C. or above.

The inventors of the present invention have conducted extensive studies on the method to apply cold-working on the inner surface of small-diameter and long steel tube. They have found that the Cr-enriched inner layer scale formed on the inner surface of the steel tube significantly improves the resistance to steam oxidation against high temperature steam during the exposure to high temperature steam in a thermal power plant. That is, the inventors of the present invention have invented the present invention by the following findings. (1) The steel tube for boiler prepared in the prior art has insufficient resistance to steam oxidation under the steam temperature of 593° C. or higher even with the steel tube having work-hardened inner surface, although the steel tube has sufficient resistance to steam oxidation under the steam temperature of 569° C. This is because the Cr-enriched inner layer scale is insufficiently formed on the inner surface of the steel tube. (2) The formation of the Cr-enriched inner layer scale depends not only on the magnitude of the cold-working but also on the Cr concentration in the vicinity of the inner surface of the steel tube. Both conditions, the magnitude of cold-working on the inner surface of the steel tube and the Cr concentration in the vicinity of the inner surface of the steel tube, are necessary to create the Cr-enriched inner layer scale to improve the resistance to steam oxidation.

The present invention provides an austenitic stainless steel tube for boiler, containing 16 to 20% Cr by weight, being formed by cold-working at the inner surface of the steel tube. The Cr concentration in the vicinity of the inner surface of the tube being 14% by weight or larger, and the hardness at 100 μm depth from the inner surface of the tube being 115 times or larger the average hardness of the mother material or being HV 300 or larger. The cold working to the inner surface of the steel tube is preferably applied by shot-blast working.

The present invention further provides a method for manufacturing an austenitic stainless steel tube for boiler, comprising the steps of: (a) preparing a hot-rolled base tube of austenitic stainless steel or hot-extruded base tube, containing 16 to 20% Cr by weight; (b) applying solution heat treatment to the hot-rolled base tube or the hot-extruded base tube; (c) removing the oxide scale formed on the inner surface of the steel tube and a part of mother material at the inner surface of the solution heat-treated steel tube, thereby descaling so as the Cr concentration in the vicinity of the inner surface of the steel tube to be 14% by weight or larger; and (d) applying cold-working to the inner surface of the descaled steel tube so as to increase the hardness at 100 μm depth from the inner surface of the descaled steel tube to 1.5 times or larger the average hardness of the mother material or to HV 300 or larger. The method can also comprise the step of (b2) applying cold-rolling or cold-drawing to the hot-rolled base tube or the hot-extruded base tube, between the step (a) and the step (b).

BEST MODE FOR CARRYING OUT THE INVENTION

The present invention is described below in detail. The present invention is characterized in that the austenitic stainless steel having the Cr content of 16 to 20% by weight improves the resistance to high temperature steam oxidation by the Cr-enriched inner layer scale formed on the inner surface of the steel tube during the exposure to high temperature steam. Formation of the Cr-enriched inner layer scale depends both on the magnitude of cold-working applied to the inner surface of the steel tube and on the Cr concentration in the vicinity of the inner surface of the steel tube. At first, the insufficient formation of the Cr-enriched inner layer scale is explained. The phenomenon is realized when the magnitude of cold-working on the inner surface of the steel tube is insufficient and the Cr concentration in the vicinity of the inner surface of the steel tube is below the specified concentration.

A thin inner layer scale in which Cr is enriched is formed on the inner surface of the steel tube subjected to cold-working, in the initial oxidizing stage during the exposure of the steel tube to steam of 600° C. to 650° C. These temperature ranges are actual operating temperatures of steel tube for boiler. The formation of the Cr-enriched inner layer scale, which depends on the magnitude of cold-working, is the main reason to improve the resistance to steam oxidation. The Cr-enriched inner layer scale is formed by the Cr diffusion from the mother material in the vicinity of the inner surface of the steel tube to the inner surface thereof. In addition, the Cr diffusion is increased with the magnitude of cold-working on the inner surface of the steel tube. The thickness of the formed scale is as thin as 1 μm or smaller even after holding the steel at the steam of 650° C. for 1000 hours. Even a steel tube after fully cold-worked, however, may form local scale in a spherical shape having a size of several tens of micrometers by the steam oxidation. The coarse spherical scale has, however, no improving effect for the resistance to steam oxidation. The inventors of the present invention have found that both the magnitude of cold-working and the Cr concentration in the vicinity of the inner surface of the steel tube significantly contribute not to create the coarse scale.

Figure 1:
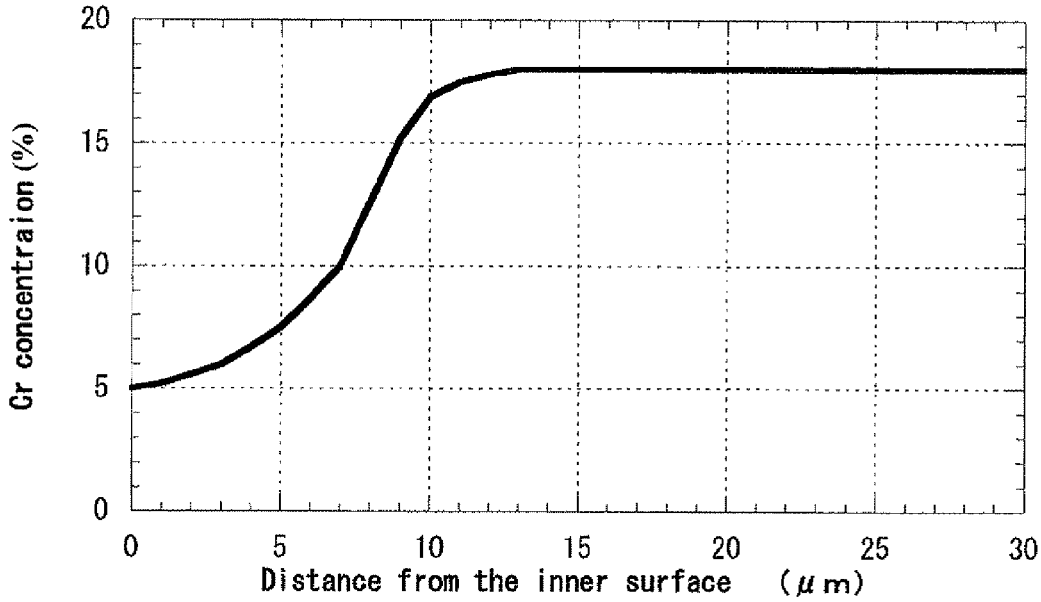
FIG. 1 shows the Cr concentration along the thickness direction from the inner surface of austenitic stainless steel tube after final solution treatment.

An austenitic stainless steel tube in actual production is subjected to final solution treatment at 1000° C. or higher temperature. The solution treatment temperature may be elevated to 1100° C. or higher for the steel tubes having high strength at higher temperature. During the solution treatment, the oxide scale is formed on the inner surface of the steel tube. As shown in FIG. 1, after the formation of oxide scale and the descaling thereof, the distribution of Cr concentration along the thickness direction from the uppermost surface of the steel tube significantly decreases at the mother material part in the vicinity of the oxide scale. Although the oxide scale is removed by descaling such as acid pickling, a significantly reduced Cr content zone may be left behind at the inner surface of the steel tube after removing the oxide scale depending on the descaling. When the cold-working on the inner surface of the steel tube is sufficient but the Cr concentration in the reduced Cr content zone is below the specific value, the Cr-enriched inner layer scale on the inner surface of the steel tube dose not improve the resistance to high temperature steam oxidation effectively.

Thus, to determine the Cr concentration in the reduced Cr content zone, small-diameter and long steel tubes were treated by shot-blasting after descaling under various descaling conditions to remove the oxide scale formed by solution treatment, and to removing a part of the reduced Cr content zone in the inner surface of the steel tube after the final solution treatment. Then, test specimens for analysis were cut from the center part in the longitudinal direction of the shot-blasted steel tubes. With thus prepared test specimens, the Cr concentration in the vicinity of the inner surface of the steel tube was determined by an electron probe microanalyzer (EPMA), and the steam oxidation test was given. Thus, the relation between the Cr concentration in the vicinity of the inner surface of the steel tube and the steam oxidation test result are examined. The term "in the vicinity of the inner surface of the steel tube" referred to herein signifies the positions of 4 to 6 μm depths from the uppermost surface of the inner surface of the steel tube (hereinafter referred to as "5 μm depth from the inner surface of the steel tube") The following results were obtained. For the austenitic stainless steel tubes containing Cr of 16 to 20% by weight, excellent resistance to steam oxidation against high temperature steam of 593° C. or above is achieved by applying descaling so as the Cr concentration at the 5 μm position from the inner surface of the steel tube to be 14% by weight or more, and by applying succeeding cold-working at a satisfactory magnitude.

Figure 2:
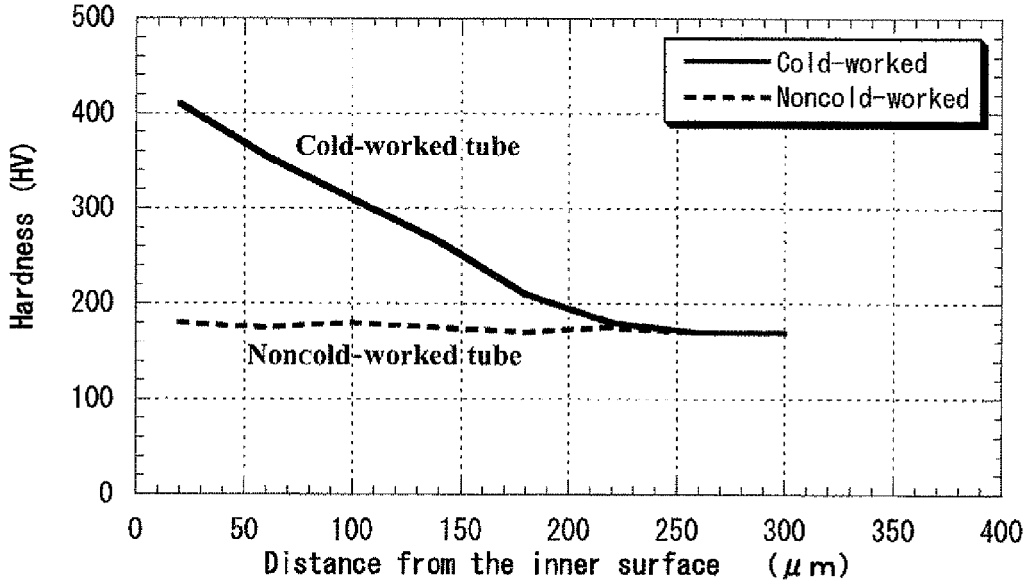
FIG. 2 shows the hardness distribution along the thickness direction from the inner surface of austenitic stainless steel tube for boiler, which inner surface was cold-worked by shot-blasting, compared with the hardness of non cold-worked steel tube.

The effect of the magnitude of cold-working on the resistance to high temperature steam oxidation was then investigated. The cold-working accelerates the Cr diffusion in the vicinity of surface at the operating temperatures of steel tubes for boiler, and improves the resistance to steam oxidation. If the cold-working is insufficient, the Cr diffusion fails to fully proceed, which results in the formation of thick scale, instead of forming the Cr-enriched thin layer scale. As shown in FIG. 2, an austenitic stainless steel tube cold-worked by shot-blasting gradually decreases the hardness along the thickness direction of the steel tube starting from the uppermost surface of the inner surface of steel tube, and reaches the average hardness of the mother material determined by the chemical composition and the heat treatment condition. On the other hand, a non cold-worked steel tube gives almost constant hardness in the thickness direction starting from the uppermost surface of the inner surface of steel tube.

From these investigations, the magnitude of cold-working, which is an important factor to control the resistance to steam oxidation, is controlled by the absolute hardness, or the specified hardness at a specified position in the thickness direction from the inner surface of the steel tube, rather than how wide the hardened zone determined by the depth of the cold-worked layer. More specifically, it is necessary that the hardness of 100 μm depth from the inner surface of the steel tube is 1.5 times or larger the average hardness of the mother material, or the hardness is HV 300 or larger. The term "100 μm depth from the inner surface of the steel tube" referred to herein signifies the position of a depth range from 95 to 105 μm from the uppermost surface of the inner surface of the steel tube, which corresponds to a position approximately half the depth of the cold-worked layer.

The austenitic stainless steel tube according to the present invention and the method for manufacturing thereof are described below in more detail.

The present invention directs to an austenitic stainless steel containing Cr from 16 to 20% by weight. For superheater or reheater in thermal power plant, adequate material and grade are selected from the group consisting of carbon steel, alloyed steel, high Cr ferrite steel, and austenitic steel depending on the operating temperatures in view of high strength and economy. Among them, the austenitic stainless steel containing 16 to 20% Cr by weight is used at the highest temperature positions in superheater or reheater because of high level of high temperature strength and of cost advantage. Carbon steel, alloyed steel, or high Cr ferrite steel, which is used at the positions of relatively low temperatures, dose not raise problems of oxide scale exfoliation even when the oxide scale grows up on the inner surface of the steel tube because of their smaller thermal expansion coefficient than austenitic stainless steel. The scale exfoliation, however, is a serious issue for the austenitic stainless steel because of its larger thermal expansion coefficient and being used at higher operating temperatures.

The austenitic stainless steels containing 16 to 20% by weight of Cr include the 18-8 stainless steels defined generally by JIS such as grade 304 (18 to 20% Cr by weight), grade 316 (16 to 18% Cr by weight), grade 321 (17 to 20% Cr by weight), and grade 347 (17 to 20% Cr by weight). Other than those grades, the stainless steels registered in the Japanese Thermal Power Technology Standard and the stainless steels registered in ASME, such as grade 304J1 (17 to 19% Cr by weight), grade 321J1 (17.5 to 19.5% Cr by weight), grade 321J2 (17.5 to 19.5% Cr by weight), and grade 347J1 (17 to 206 Cr by weight) are also included in the applicable stainless steels according to the present invention.

According to the present invention, the step (a) a hot-rolled base tube or a hot-extruded base tube of an austenitic stainless steel containing 16 to 20% Cr by weight is prepared. The step (a) of preparing the base tube is carried out by a known method for manufacturing seamless steel tube. Then, the step (b) the hot-rolled base tube or the hot-extruded base tube is treated by solution heat treatment. The step (b) of solution heat treatment is generally given at 1000° C. or higher temperature. A steel tube of high level of high temperature strength may be subjected to solution heat treatment at 1100° C. or higher temperature. Although the base tube may be directly subjected to solution heat treatment as above, the base tube may be cold-worked before applying solution heat treatment. That is, the step (b2) of applying cold-working or cold-drawing to the hot-rolled base tube or the hot-extruded base tube may be given in between the steps of (a) and (b).

The steel tube after subjected to solution heat treatment is then treated by the step (c), where the oxide scale formed on the inner surface of the steel tube and a part of the mother material on the inner surface of the steel tube are removed by descaling so as the Cr concentration in the vicinity of the inner surface of the steel tube to be 14% by weight or larger. The step (c) of descaling may be done either by pickling using an acid or by mechanical removal, if the oxide scale on the inner surface of small-diameter and long steel tube and the zone of Cr concentration smaller than 14% by weight, can be removed.

As described before, in the austenitic stainless steel containing 16 to 20% Cr by weight, Cr is enriched in the oxide scale formed during the final solution treatment, thus the Cr content in the mother material decreases, and, particularly in the mother material in the vicinity of interface to the scale, the Cr concentration may decrease to near 10%, even when the Cr content in the mother material is 18% by weight (FIG. 1). The succeeding descaling using acid removes a part of the mother material in the inner surface together with the surface oxide scale. Generally, however, the reduced Cr content zone will be remained in the inner surface of the steel tube. If the Cr concentration in the reduced Cr content zone is smaller than 14% by weight, succeeding sufficient cold-working on the inner surface of the steel tube cannot fully promote the Cr diffusion during the exposure to the high temperature steam, thus the Cr-enriched inner layer scale is not sufficiently formed. According to the present invention, the minimum value of the reduced Cr concentration to enhance the desired Cr diffusion was confirmed to be 14% Cr by weight in the vicinity of the inner surface of the steel tube (the 5 μm position from the inner surface of the steel tube).

After subjected to the descaling, the steel tube is treated by (d) cold-working on the inner surface of the descaled steel tube so as the hardness at 100 μm depth from the inner surface of the steel tube to be 1.5 times or larger the average hardness of the mother material or to be HV 300 or larger. The cold-working is applied to the inner surface of the steel tube by the methods of drawing the steel tube in cold state, inserting a plug into the steel tube to rub the inner surface thereof, grinding the inner surface thereof, and rotating a ring inserted in the tube at an eccentric position as well as shot-blasting.

All of these methods of cold-working on the inner surface of the steel tube can form a hardened zone where the hardness at 100 μm depth from the inner surface of the steel tube is 1.5 times or larger the average hardness of the mother material or is HV 300 or larger. In particular, the shot-blasting is preferred from the point of simplicity of apparatus and of controllability of hardness to provide a desired work-hardening on the inner surface of the steel tube. The operating condition of shot-blasting may adequately select the particles of shot-blasting, the pressure for blasting the particles, and the volume of blasting particles so as to attain the above-described hardness on the inner surface of the steel tube.

The improvement in the resistance to steam oxidation according to the present invention is reasoned by forming the Cr-enriched inner layer scale due to the Cr diffusion from the mother material to the inner surface side of the steel tube. The Cr-enriched inner layer scale is formed by exposing the steel tube to 600° C. to 650° C. steam, which is the actual operating steam temperature region, during the initial stage of oxidation induced. To form the Cr-enriched inner layer scale, a specific magnitude of cold-working as well as a specific Cr concentration of 14% by weight or larger in the vicinity of the inner surface of the steel tube are necessary to enhance the Cr diffusion. The specific magnitude of cold-working is determined by the hardness at 100 μm depth from the inner surface of the tub. The critical value is 1.5 times or larger the average hardness of the mother material or is HV 300 or larger. The austenitic stainless steel tube treated by the methods of the prior art such as grain refinement, heat treatment after cold-working, or shot-blasting on the inner surface of the steel tube has insufficient resistance to steam oxidation at high temperatures and for a long period to suffer from the scale exfoliation in actual plants. Those drawbacks are caused by not-satisfying either of the two requirements of the present invention, which requirements are essential to attain the resistance to steam oxidation.

EXAMPLES

The present invention is described in the following in more detail referring to the examples. Nevertheless, the present invention is not limited to these examples.

A hot-extruded base tube was subjected to a known process of cold-drawing, solution heat treatment, and descaling by a solution of 10% nitric acid and 2% fluoric acid at room temperature. Then the base tube was subjected to shot-blasting on the inner surface thereof to manufacture the 18-8 austenitic stainless steel tubes (Nos. A to G) for superheater or reheater The grades were SUS321H, SUS347H, SUS316H, and SUS321J1H which is a material of the Thermal Power Technology Standard. The size of the steel tube is given in Table 1 in terms of outer diameter and wall thickness. The length of the steel tube was 600 mm. The descaling was given in the above pickling solution for 15 minutes for Steel tube Nos. A to D, and 5 minutes for Steel tube Nos. E and F. The shot-blasting was done under the blasting pressure of 4.0 $kg/cm^2$ or higher and the blasting volume of 0.023 $kg/cm^2$/min or larger, while varying the blasting pressure to give a various hardness of Steel tube Nos. A to F and Steel tube No. G.

From the center in the longitudinal direction of the steel tube after shot-blasting, specimens for analysis were cut, and the Cr content in the mother material and the Cr concentration at 5 μm depth from the inner surface of the steel tube were determined by an electron beam microanalyzer EPMA (JXA8900RL) of JEOL Ltd. In addition, specimens for hardness determination and for steam oxidation determination were cut from the steel tube. The position for determining the hardness was at the center in the thickness direction of the steel tube and at 100 μm depth from the inner surface of the steel tube. The hardness was determined by Vickers hardness tester with a load of 10 kg at the center of the thickness direction of the steel tube, and with a load of 100 g at 100 μm depth from the inner surface of the steel tube. The hardness was determined by the average of 5 points for each part. The steam oxidation test was given in accordance with JIS Z2287-2003. The test temperature and the test time were 600° C., 650° C. and 700° C. for 300 hours. After the steam oxidation test, the peripheral face of the specimen was polished, and the oxide scale formed on the inner surface of the steel tube was observed by an optical microscope to determine the scale thickness. The evaluation of scale thickness was given as: "○" for smaller than 5 μm, "Δ" for 5 to 10 μm, and "X" for larger than 10 μm. The results are given in Table 1.

Steel tube Nos. A to D are the examples of the present invention, giving 14% by weight or higher Cr concentration in the vicinity of the inner surface of the steel tube and having 1.5 times or larger the average hardness of the mother material or having HV 300 or larger hardness. All of these examples provide oxide scale thickness of smaller than 5 μm even in the steam oxidation test at 600° C., 650° C. and 700° C. for 3000 hours, showing excellent resistance to high temperature steam oxidation. On the other hand, Steel tube Nos. E and F, comparative examples having the Cr concentration of smaller than 14% by weight at 5 μm depth from the inner surface of the steel tube, gave oxide scale thickness of 5 μm or larger. Steel tube No. G, having the hardness of smaller than 1.5 times that of the average hardness of the mother material and HV 253 at 100 μm depth from the inner surface of the steel tube, show poor resistance to steam oxidization to form thick spherical oxide scale having 10 μm or larger size.

Figure 3:
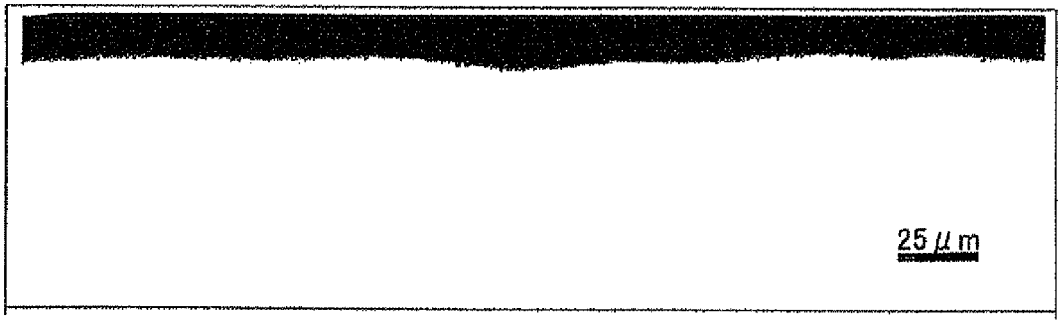
FIG. 3 is a photograph of formed inner surface scale of Steel No. A of the present invention, after the steam oxidation test at 700° C. for 3000 hours.
Figure 4:
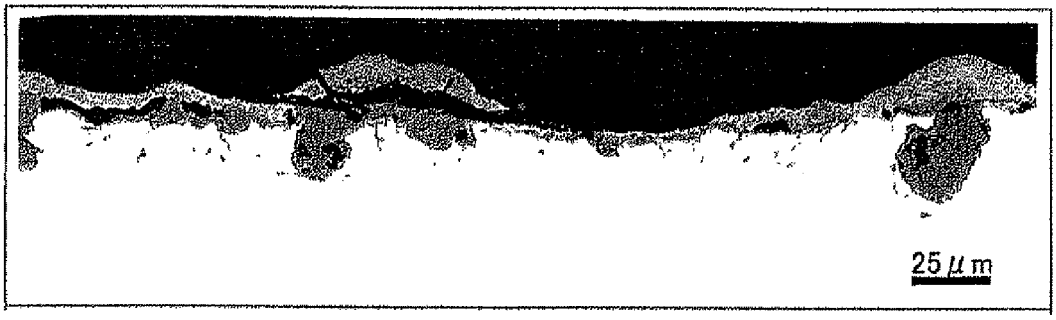
FIG. 4 is a photograph of formed inner surface scale of Steel No. C of comparative example, after the steam oxidation test at 650° C. for 3000 hours.

FIG. 3 shows a photograph of cross section of inner surface of steel tube No. A after the steam oxidation test at 700° C. for 3000 hours. The oxide scale is as thin as invisible under the optical microscope. FIG. 4 is a photograph of Steel tube No. G after the steam oxidation test at 650° C. for 3000 hours, which shows the formed spherical oxide scale having several tens of micrometers in size. The spherical oxide scale easily exfoliates from the outer layer to raise various troubles. Therefore, the austenitic stainless steel of the present invention has distinctively superior resistance high temperature steam oxidation over the comparative example steels.

TABLE 1

| Steel tube | Steel grade | Size (outer diameter × Wall thickness) (mm) | Cr content In mother material (%) | Cr consentration At 5 μm depth from the inner surface (%) | Hardness of mother material (HV) | Hardness at 100 μm depth from the inner surface (HV) | HV 100 μm/ HV mother material |
|---|---|---|---|---|---|---|---|
| A | SUS321H | 45 × 8.0 | 17.9 | 16.5 | 168 | 310 | 1.85 |
| B | SUS321H | 57 × 4.5 | 17.4 | 15.8 | 175 | 305 | 1.74 |
| C | SUS347H | 51 × 8.0 | 17.5 | 15.5 | 155 | 240 | 1.55 |
| D | SUS321J1 | 51 × 3.2 | 18.2 | 16.3 | 195 | 330 | 1.69 |
| E | SUS316H | 45 × 6.0 | 16.4 | 12.5 | 167 | 314 | 1.88 |
| F | SUS321H | 64 × 4.2 | 18.0 | 13.4 | 180 | 310 | 1.72 |
| G | SUS321J1 | 51 × 4.0 | 17.6 | 15.8 | 177 | 253 | 1.43 |

| Steel tube | Steam oxidized scale at 600 C. for 3000 h | Steam oxidized scale at 650 C. for 3000 h | Steam oxidized scale at 700 C. for 3000 h | Remark |
|---|---|---|---|---|
| A | ○ | ○ | ○ | invention |
| B | ○ | ○ | ○ | invention |
| C | ○ | ○ | ○ | invention |
| D | ○ | ○ | ○ | invention |

TABLE 1-continued

| | | | | |
|---|---|---|---|---|
| E | X | X | X | comparative |
| F | Δ | Δ | X | comparative |
| G | X | X | X | comparative |

INDUSTRIAL APPLICABILITY

The present invention improves the resistance to steam oxidation on the inner surface of austenitic stainless steel tube for superheater or reheater used at 593° C. or higher steam temperatures. Thus, the austenitic stainless steel of the present invention is a promising material in the future high efficiency power plant and significantly contributes to the stable operation of power plant over a long period.

The invention claimed is:

1. An austenitic stainless steel tube for boiler, comprising 16 to 20% Cr by weight, being formed by cold-working at an inner surface of the tube after solution heat treatment followed by descaling in an acid solution to eliminate both an oxide scale formed on the inner surface of the tube and a part of the mother material at the inner surface of the tube, the Cr concentration at the 5 μm position from the inner surface of the tube being in the range of 14% by weight or larger and not exceeding a Cr content of the mother material being 16 to 20% by weight, and the hardness at 100 μm depth from the inner surface of the tube being 1.5 times or larger the average hardness of the mother material or being HV 300 or larger.

2. The austenitic stainless steel tube for boiler according to claim 1, wherein the cold-working is shot-blasting.

3. A method for manufacturing austenitic stainless steel tube for boiler, comprising the steps or (a) preparing a hot-rolled base tube of austenitic stainless steel or hot-extruded base tube, containing 16 to 20% Cr by weight;

(b) applying solution heat treatment to the hot-rolled base tube or the hot-extruded base tube thereof;

(c) after solution heat treatment, eliminating an oxide scale formed on the inner surface of the tube and a part of the mother material at the inner surface of the tube, thereby descaling so as the Cr concentration at the 5 μm position from the inner surface of the tube to be in the range of 14% by weight or larger and not exceeding a Cr content of the mother material being 16 to 20% by weight; and (d) applying cold-working to the inner surface of the descaled tube so as the hardness at 100 μm depth from the inner surface of the descaled tube is 1.5 times or larger the average hardness of the mother material or become HV 300 or larger.

4. The method for manufacturing austenitic stainless steel tube for boiler according to claim 3, further comprising the step of (b2) applying cold-rolling or cold-drawing to the hot-rolled base tube or the hot-extruded base tube, between the step (a) and the step (b).

* * * * *

UNITED STATES PATENT AND TRADEMARK OFFICE

CERTIFICATE OF CORRECTION

PATENT NO. : 8,034,198 B2
APPLICATION NO. : 12/438526
DATED : October 11, 2011
INVENTOR(S) : Yusuke Minami et al.

It is certified that error appears in the above-identified patent and that said Letters Patent is hereby corrected as shown below:

Column 10, Line 9, Claim 3, delete "or" and insert -- of: --

Signed and Sealed this
Thirty-first Day of January, 2012

David J. Kappos

David J. Kappos
*Director of the United States Patent and Trademark Office*